US006027588A

United States Patent [19]

Vattipalli et al.

[11] Patent Number: 6,027,588

[45] Date of Patent: Feb. 22, 2000

[54] METHOD OF MANUFACTURE OF EMULSION EXPLOSIVES

[75] Inventors: Mohan Rao Vattipalli, New Bombay; Chandramouli Gajelli, Mumbai; Krishnan Subramanian, Maharashtra; Sathyawan Kumar Nayak, Bihar; Ram Narain Sinha, Bihar, all of India

[73] Assignee: Orica Explosives Technology Pty Ltd, Melbourne, Australia

[21] Appl. No.: 08/911,772

[22] Filed: Aug. 15, 1997

[51] Int. Cl.[7] ..... C06B 21/00

[52] U.S. Cl. ..... 149/109.6; 149/2; 149/46

[58] Field of Search ..... 149/2, 46, 109.6

[56] References Cited

U.S. PATENT DOCUMENTS

| | | | |
|---|---|---|---|
| 4,075,252 | 2/1978 | Boudakian | 570/141 |
| 4,246,052 | 1/1981 | Hagel et al. | 149/23 |
| 4,305,766 | 12/1981 | Edmonds et al. | 149/2 |
| 4,409,044 | 10/1983 | Bhattacharyya et al. | 149/2 |
| 5,074,939 | 12/1991 | Sanders et al. | 149/21 |
| 5,296,380 | 3/1994 | Margalit | 436/106 |
| 5,500,062 | 3/1996 | Chattopadhyay | 149/46 |
| 5,507,889 | 4/1996 | Mullay et al. | 149/2 |
| 5,648,047 | 7/1997 | Kardish et al. | 422/56 |

*Primary Examiner*—Edward A. Miller
*Attorney, Agent, or Firm*—Pillsbury Madison & Sutro

[57] ABSTRACT

Water in oil emulsion explosives are prepared by a process in which diazonium salts are incorporated into the explosives matrix and decomposed in-situ.

10 Claims, 3 Drawing Sheets

Curve-1. The gassing system comprised sodium nitrite-sodium thiocyanate mixture.

Curve-2. The gassing system comprised 2-methyl phenyldiazonium sulphate prepared from o-toluidine.

Theoretically, a final product density of 0.62 g/ml should be obtained upon 100% gas decomposition and entrapment.

Legends for Figure-1

Curve-1. The gassing system comprised sodium nitrite-sodium thiocyanate mixture.

Curve-2. The gassing system comprised 2-methyl phenyldiazonium sulphate prepared from o-toluidine.

Theoretically, a final product density of 0.62 g/ml should be obtained upon 100% gas decomposition and entrapment.

Legends for Figure-2

Curve-1. The gassing system comprised sodium nitrite-sodium thiocyanate mixture.

Curve-2. The gassing system comprised phenyldiazonium sulphate prepared from Aniline.

Curve-3. The gassing system comprised 2-methyl phenyldiazonium sulphate prepared from o-toluidine.

FIGURE-3

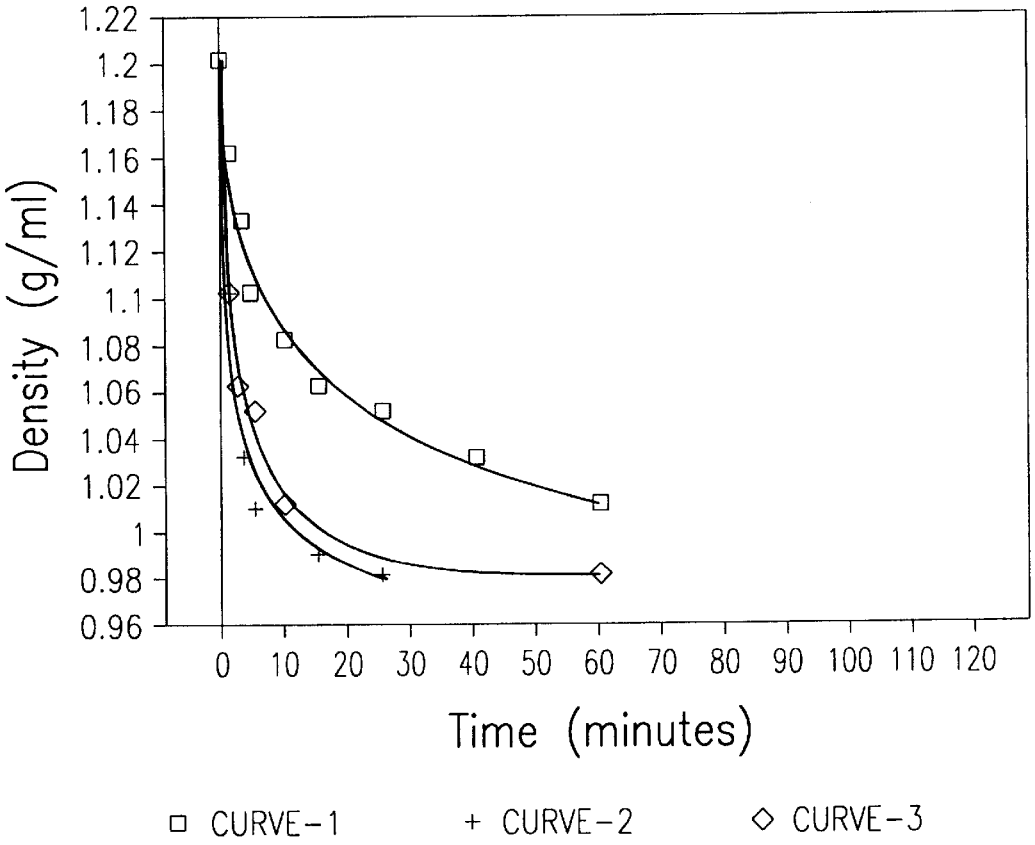

Legends for Figure-3

Curve-1. The gassing system comprised sodium nitrite in aqueous solution form.

Curve-2. The gassing system comprised phenyldiazonium sulphate prepared from Aniline.

Curve-3. The gassing system comprised Anilinehydrochloride incorporated into the oxidiser prior to emulsification and aqueous solution of sodium nitrite incorporated into the emulsion matrix.

METHOD OF MANUFACTURE OF EMULSION EXPLOSIVES

FIELD OF INVENTION

This invention relates to Explosives of non-Nitroglycerine type used in the mining industry. Especially, the present invention relates to generation of gas voids in Ammonium Nitrate based explosives such as Emulsion explosives/Slurry explosives/Heavy ANFO and Doped emulsions. A special aspect of the invention relates to lowering the density of such explosives at ambient to low temperature conditions.

BACKGROUND

Non-nitroglycerine explosives based on Ammonium nitrate such as Slurries, also known as watergels, Emulsions and ANFO mixtures require entrapped gas bubbles, tiny in size, for initiation and sustenance of the process of detonation. These bubbles or voids when compressed adiabatically by the shock-wave generated by the initiating charge behave as "hot-spots" and initiate the combustion reaction that finally leads to detonation. Incorporation of such voids can be done by several means that could be described under the following four broad categories:

—Incorporation into the explosive matrix materials containing entrapped voids,

—physical means

—mechanical action

—chemical means

Under the first category, use of particulate materials such as hollow glass microballoons, plastic spheres, Perlites, volcanic ash, silicon sand, sodium silicate etc., is well known. This low density particulate matter retain the enclosed air even after mixing into the explosive and thus provide the hot-spots for detonation. Over the years it was found that while glass microballoons were effective performers others were not as effective. The glass microballoons on the other hand are expensive and pose handling problems due to their low bulk density.

In addition to the above, gas retaining agents such as foamed polystyrene, foamed polyurethane and the likes were disclosed in the U.S. Pat. No. 4,543,137. These were rigid or soft and spongy depending upon the resin employed for their preparation. However, the main problem with their usage is their participation in the combustion process as fuels leading to limitation in their usage levels or alternately undesirable oxygen-deficient situation.

The aspect of participation as fuel was taken care of in U.S. Pat. No. 5,409,556 by use of expanded grains such as expanded popcorn, expanded rice or expanded wheat for density reduction. It was claimed that these materials being carbohydrates were not good fuels and did not significantly alter the oxygen balance of the explosive composition when used in the small amounts required for density reduction.

Use of gas-in-liquid and gas-in-solid foams was disclosed in the Canadian Patent Applications 2093309 and 2113945 as means to incorporate voids. The foams consisted of mechanically or chemically generated gas locked in open or closed cellular structures. These foams contained, besides foam forming agents, substances such as TNT, Ammonium nitrate, Sodium nitrate etc., to further manipulate their sensitizing ability.

In the second category a new route to generating gas bubbles within the explosive matrix was disclosed in UK Patent Application 2179035. This involved dissolving the gas in the matrix under application of high pressure followed by sudden release to atmospheric pressure that then results in formation of gas bubbles due to the solubility differential for the gas in the matrix between high and ambient pressures. However, the main disadvantage of this method is that it requires specialized equipment for handling sensitized emulsions at high pressures.

In the third category we have the void generation by mechanical action. During prolonged mixing or intensive agitation voids get entrapped into the matrix due to its viscous nature. This method has the disadvantage that prolonged shearing could adversely affect long-term stability of the product.

The well-known alternative to above means of incorporating voids is to generate them in-situ by means of a chemical reaction. This technique, known in the industry circles as chemical gassing, is described in numerous patents viz., U.S. Pat. Nos. 3,886,010, 3,706,607, EP 0655430A1 to name a few. Several gas generating reactions involving chemical substances such as nitrites, weak acids, hydrazines and peroxides have been patented. One of the most commonly practiced reaction is that of sodium nitrite reacting with the ammonium nitrate present in the explosive matrix to produce nitrogen gas that gets entrapped in the form of bubbles in the viscous matrix.

The matrix of a water-in-oil emulsion explosive is prepared by mixing under agitation the aqueous and oil phases. The former phase contains salts such as ammonium nitrate, sodium nitrate, calcium nitrate etc., dissolved in water while the latter contains waxes, oils and emulsifiers. The emulsion matrix is prepared either by a batch process or a continuous process or combinations thereof employing different kinds of rotary mixers, static mixers, jet mixers, colloid mills, votators etc. The gassing agent is mixed into the emulsion matrix either in a rotary mixer or employing static mixers. Sometimes the aqueous solution of sodium nitrite is emulsified and incorporated as a water-in-oil emulsion to facilitate better mixing and derive benefits arising thereby as claimed in world patent WO 89/02881.

In the manufacture of watergel explosives, oxidizer salts such as ammonium nitrate, sodium nitrate, calcium nitrate etc are dissolved in water at above ambient temperatures and the resultant solution thickened (or gelled) using substances such as guar gum and subsequently crosslinked using metal ions such as chromium in suitable form. Optionally solid particulate materials like Aluminium are dispersed into the matrix. Here again gassing is usually the last operation that involves mixing in of aqueous solution of sodium nitrite.

Ammonium nitrate, in the form of porous prills as such can be mixed with fuel oil to form an explosive known as ANFO. While this itself is a popular explosive, in certain mining operations it is blended with water-in-oil emulsion in different proportions to render water-proofness as well as increased product density. The emulsion matrix used for blending is sometimes gassed to ensure satisfactory detonation performance of the final product. These products are generally known in the industry as Heavy ANFO.

Complementary to Heavy ANFO, we have what is known in the industry as doped emulsions. Here prills of ammonium nitrate or ANFO are mixed into the emulsion explosive matrix to enhance its performance. It is generally understood that in a doped emulsion the dopant constitutes a minor faction of the total composition.

The sodium nitrite—ammonium nitrate gassing reaction suffers from several drawbacks limiting its use. These are: difficulty in controlling the reaction rate, slowing down of the reaction at ambient and low temperature conditions, mass transfer problems causing the reaction to remain incomplete for several days etc.

The mass transfer problems arise due to the formation of discrete droplets when the aqueous solution of sodium nitrite is mixed into the emulsion matrix. While the mixing process is on there is a dynamic equilibrium between formation of new droplets and recombination of the existing droplets. During this process the sodium nitrite reacts rapidly with the ammonium nitrate it comes across but once the mixing process is stopped further reaction becomes diffusion dependent due to the two reactants being separated across the bilayer and slows down considerably. In the manufacture of cartridged explosives this situation could lead to continuation of the gassing reaction for several days after the cartridges are end-clipped leading to bursting of the cartridges.

Since the reaction is acid-catalysed, addition of acid can speed up the process of gassing but this method again has its limitations because highly acidic conditions lead to formation of undesirable oxides of nitrogen in place of nitrogen gas. The nitric oxide (NO) upon contact with air readily forms the dioxide (NO2) which being highly soluble in water results in disappearance of voids and density rise later.

Speeding up of the gassing reaction is also achieved by use, in conjunction, of additives such as thiourea and sodium or ammonium thiocyanate etc. But despite use of these additives that are known in the art as gassing accelerators, the gassing process slows down considerably when the process temperatures are near ambient. This aspect assumes much importance in today's mining industry in which explosives are more and more used in "Bulk" form.

In this scheme, the ungassed explosive matrix is transported to the mine bench where it is gassed and simultaneously loaded into the borehole saving much effort and material involved in sausage preparation. Thus it often becomes necessary to undertake the gassing at temperatures that could be well below the normal factory processing temperatures of 70–100° C. and here slowing down of the gassing reaction with temperature becomes a major handicap. As a case of non-limiting example mining operations in a province like Himachal Pradesh are done with surface temperatures for most of the year remaining around 10° C. Delayed gassing in such operations could cause hold-up of the subsequent operations such as stemming, priming of the holes etc.

Thus need is felt for a method of generating voids that is devoid of all the above mentioned problems and amenable to operation under cold climatic conditions. We describe here below such a method.

SUMMARY OF THE INVENTION

In its most general form, the present invention involves generation of gas bubbles by in-situ decomposition of diazonium salts in the explosives matrix. The diazonium salts upon their incorporation decompose due to the heat of the matrix and evolve nitrogen gas producing the voids. The process can be effected in more than one way: The diazonium salt can be pre-prepared and used either as a solid or as an aqueous solution. It could also be prepared in-line and used-up simultaneously. Alternately the basic ingredients such as amine and acid can be incorporated into the oxidizer phase prior to preparation of the explosive matrix, i.e. emulsification or preparation of the watergel, and mixing in the nitrite solution into the matrix later.

By proper choice of the substitutent group which influences the temperature stability of the diazonium salt it is possible to meet the density reduction rate requirements over a wide range of processing temperatures. Thus the method has applicability in the manufacture of both packaged and bulk explosives.

DETAILED DESCRIPTION OF THE INVENTION

It is well known that aromatic amines upon reaction with nitrous acid in presence of mineral acids at about 0° C. form diazonium salts as discrete compounds. The nitrous acid is provided in-situ by reacting a weak base such as sodium nitrite with a strong acid. The resultant diazonium compounds when subjected to higher temperatures decompose yielding nitrogen gas.

As an example by way of illustration, aniline in presence of hydrochloric acid when made to react with an aqueous solution of sodium nitritie forms phenyl diazonium chloride. This compound when heated upto a temperature of 50° C. decomposes to give nitrogen gas and phenol with the reaction having a half-life of less than 10 minutes. In the present method of generation of gas voids, aqueous solution of the diazonium salt is incorporated into the explosive matrix such as that of a water-in-oil emulsion or a slurry wherein the diazonium salt decomposes due to the heat received from the matrix and generates bubbles of nitrogen gas. The said diazonium compound could also be prepared in-line by bringing together the amine, acid and the nitrite and simultaneously used up for gas generation or alternately the amine and acid may be incorporated into the oxidizer phase prior to preparation of the explosive matrix, be it watergel or emulsion, and aqueous solution of nitrite mixed into the matrix later.

Those skilled in the art of manufacturing explosives would understand that good dispersion of gasser solution in the explosives matrix is essential for obtaining uniform and small sized voids. The same applies in the present method employing diazonium salts as well. For the purpose of achieving good dispersion the known mixing equipment used in the industry such as low/high shear static/rotary mixers could be employed.

EXAMPLES

The following examples are given only to illustrate the present invention. These are neither comprehensive nor exhaustive of the various embodiments which can be prepared in accordance with the present invention.

Example 1

A water-in-oil emulsion of the following composition prepared in a Patterson mixer at 80° C. and cooled to a temperature of 35° C.

| | |
|---|---|
| 74.80 | Ammonium Nitrate |
| 0.10 | Zinc Nitrate |
| 18.60 | Water |
| 3.15 | Furnace Oil |
| 1.35 | Diesel Oil |
| 0.50 | Sorbitan monooleate |
| 1.50 | PIBSA based emulsifier |

It had a viscosity of 76000 c.p. as measured by Brookefield Viscometer spindle #7, 20 rpm.

Figure 1:
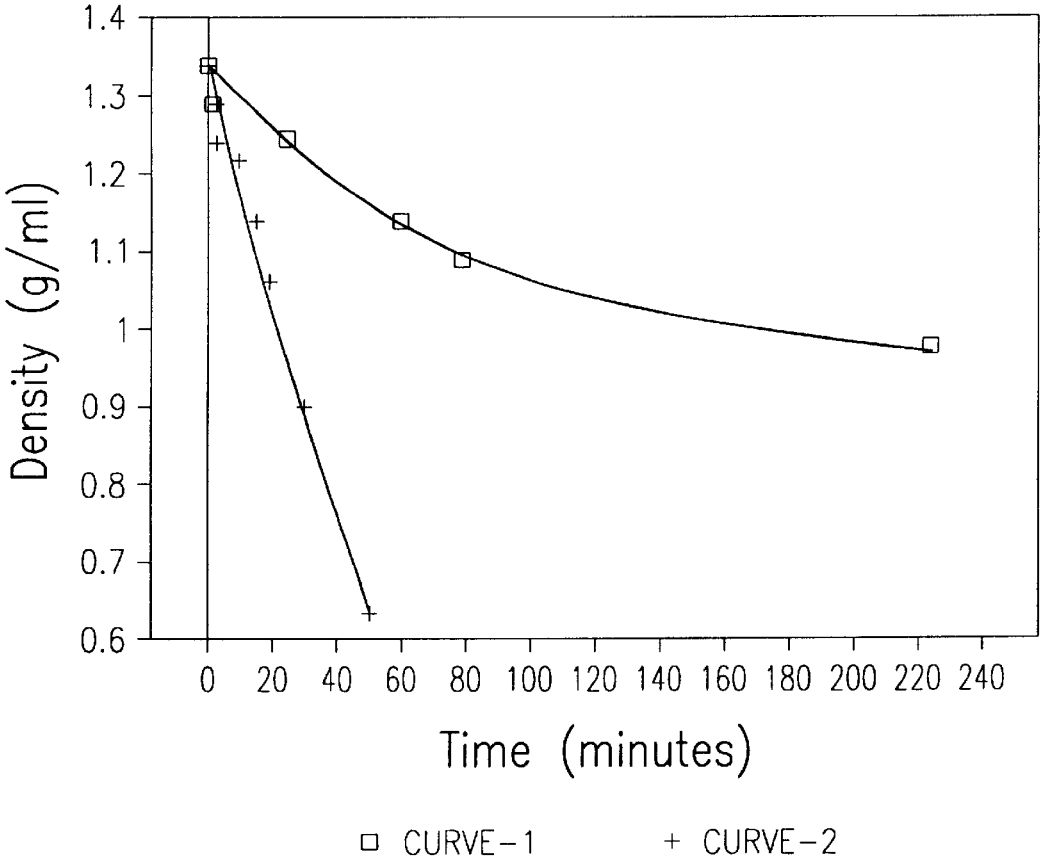

The oxidizer solution prior to emulsification was adjusted to a pH of 4.0. The matrix prior to gassing had a density of 1.350–1.325 g/ml. To this matrix weighing 10 Kg, 200 ml of gasser solution (having a density of 1.25 g/ml approx.) prepared by mixing 20 parts each by weight sodium nitrite and sodium thiocyanate and 60 parts by weight water was mixed in. The observed density reduction with time is shown in FIG. 1, curve-1. The temperature throughout was maintained at 35±1° C.

In the second experiment, to the matrix weighing 10 Kg, diazonium salt solution prepared as per the following was added:

31.33 g of o-Toluidine (2-Aminotoluene) was converted to its sulphate salt by addition of a mixture of 36.2 ml concentrated sulphuric acid (specific gravity 1.84) and 81.8 ml water. The amine was slowly added with stirring to the acid. The resultant amine salt solution was maintained at 0° C. To this a solution of sodium nitrite; containing 21.67 g sodium nitrite dissolved in 40 ml water; was added slowly with good stirring. The resultant solution, about 200 ml by volume, was clear.

The temperature of the matrix was again maintained at 35±10° C. The observed density reduction with time is shown in FIG. 1, curve-2.

As can be seen despite higher usage of the gassing agent, consisting of a mixture of sodium nitrite and sodium thiocyanate, the density reduction in curve - 1 was much slower than in curve - 2. The gassing process with the diazonium salt was not only faster but complete in 60 minutes.

It is pertinent to mention here that no abnormality of any kind was observed in the product emulsion in terms of its characteristics such as rheology, detonation behavior etc., which could be attributed to the new method of void generation.

Example 2

A water-in-oil emulsion was prepared as described in example - 1 except that the composition was as follows:

| | |
|---|---|
| Ammonium Nitrate | 56.40 |
| Water | 37.60 |
| Furnace oil | 03.15 |
| Diesel oil | 01.35 |
| PIBSA based emulsifier | 01.50 |

The pH of the AN/Water solution was adjusted to 4.0 prior to emulsification. The matrix prior to gassing had a density of 1.20–1.21 g/ml. The matrix temperature was maintained at 50±1° C.

Figure 2:
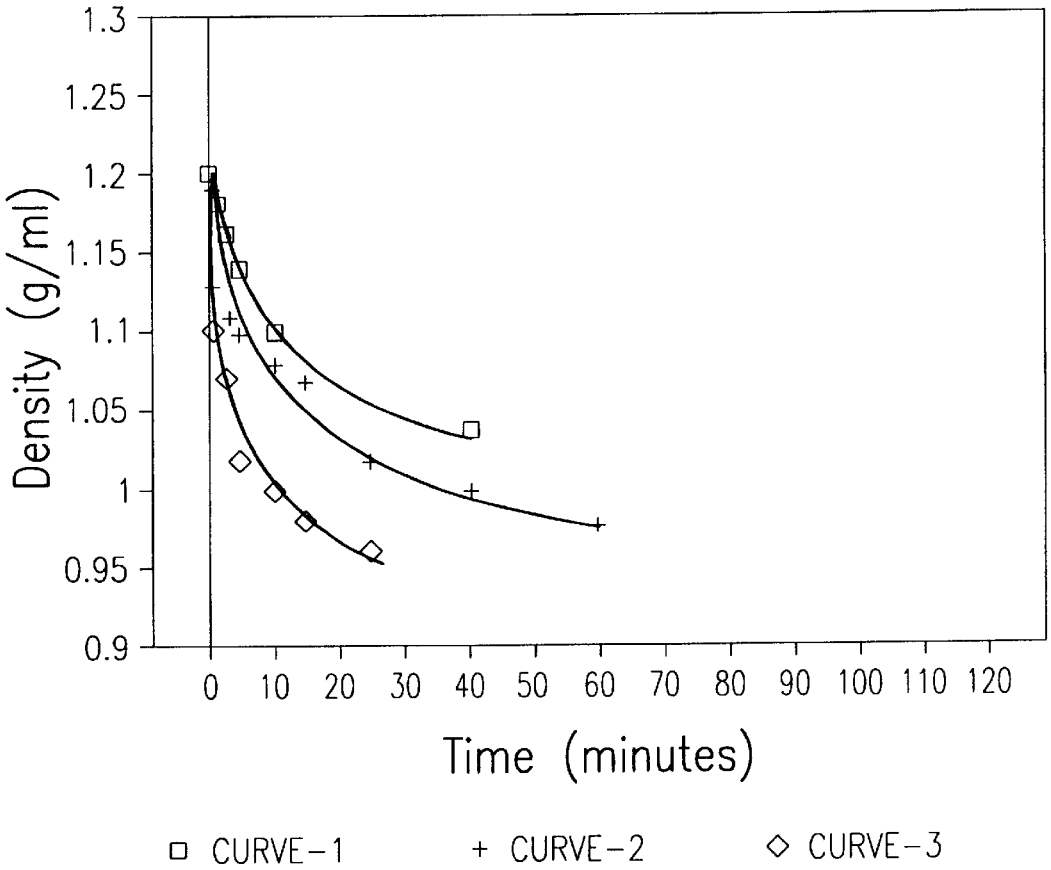

In the first experiment, 6 g of Sodium nitrite and 6 g of Sodium thiocyanate were dissolved in water and made to a volume of 65 ml and mixed into 10 Kg of the matrix. The observed density reduction with time is shown in FIG. 2, curve - 1.

In the second experiment, to the matrix weighing 10 Kg, diazonium salt solution prepared as described earlier was incorporated. The quantities used were: 8.31 g aniline (Amino benzene), 11.9 ml of concentrated sulphuric acid mixed with 27.4 ml water and 6.60 g sodium nitrite dissolved in 13.2 ml water. The total volume was about 63 ml. The observed density reduction with time is shown in FIG. 2, curve - 2.

In the third experiment, to the matrix weighing 10 Kg, diazonium salt solution prepared as described earlier was incorporated. The quantities used were: 9.57 g of o-Toluidine (2-Aminotoluene), 11.9 ml of concentrated sulphuric acid mixed with 27.4 ml water and 6.60 g sodium nitrite dissolved in 13.2 ml water. The total volume was about 65 ml. The observed density reduction with time is shown in FIG. 2, curve - 3.

As can be seen from above, the density reduction observed in case of both the diazonium salts is much faster than the nitrite - thiocyanate system.

It may be pertinent to mention here that the matrix thus prepared in the second and third experiments was used for blending with ANFO prills. No abnormality of any kind such as rheology and detonation behavior was noticeable in the product as compared to the normal product made with the emulsion matrix gassed using sodium nitrite - sodium thiocyanate system for void generation.

Example 3

A water-in-oil emulsion was prepared as described in example - 1 except that the composition was as follows:

| | |
|---|---|
| Ammonium Nitrate | 56.40 |
| Water | 37.60 |
| Paraffin oil | 04.50 |
| PIBSA based emulsifier | 01.50 |

The pH of the AN/Water solution was adjusted to 4.0 prior to emulsification. The matrix prior to gassing had a density of 1.20–1.21 g/ml and the matrix temperature was maintained at 70° C.

In the first experiment, 0.55 g of Sodium nitrite was dissolved in water and made to a volume of 6 ml and mixed into 1 Kg of the matrix. The observed density reduction with time is shown in FIG. 3, curve - 1.

In the second experiment, to the matrix weighing 1 Kg, diazonium salt solution prepared as described earlier was incorporated. The quantities used were: 0.75 g aniline (Amino benzene), 1.1 ml of concentrated sulphuric acid mixed with 2.5 ml water and 0.60 g sodium nitrite dissolved in 1.2 ml water. The total volume was about 6.5 ml. The observed density reduction with time is shown in FIG. 3, curve - 2.

In the third experiment, a mixture of 0.75 g of aniline and 0.75 ml concentrated hydrochloric acid having a pH of about 6.0 was added to the 940 g oxidizer solution prior to emulsification. This was emulsified with 60 g of fuel phase to give an emulsion matrix weighing 1 Kg and having the composition as given above. 6 ml of sodium nitrite solution containing 0.55 g sodium nitrite, was mixed into the above matrix. The observed density reduction with time is shown in FIG. 3, curve - 3.

As can be seen from FIG. 3, curves 2 & 3 which correspond to diazonium salt pre-prepared and formed in-situ display faster rate of density reduction compared to the conventional method.

From the foregoing discussion and examples it will be appreciated that the present invention provides a different, hitherto unknown, method of generating gas bubbles (voids) inside the matrix of an emulsion explosive. The examples described are only illustrative and not restrictive. The scope of the invention is therefore indicated by the claims rather than the foregoing description.

What is claimed is:

1. A method of gassing an explosive composition comprising the step of decomposing at least one aromatic diazonium salt in-situ so that nitrogen gas bubbles are generated within said explosive composition to produce voids therein.

2. A method according to claim 1 wherein the explosive composition comprises:

(i) a water-in-oil emulsion containing a continuous oil phase, a discontinuous aqueous oxidizer salt phase and one or more emulsifiers;

(ii) a watergel containing a continuous aqueous oxidizer salt phase and a dispersed solid/liquid fuel; or (iii) ammonium nitrate in mixture with fuel oil.

3. A method according to claim 1 wherein said aromatic diazonium salt is decomposed in the presence of sodium nitrite.

4. A method according to claim 1 wherein the explosive composition comprises a water-in-oil emulsion containing a continuous oil phase, a discontinuous aqueous oxidizer salt phase and one or more emulsifiers.

5. A method according to claim 1 wherein the aromatic diazonium salt is generated in-situ by incorporation of an aromatic amine and an acid in the aqueous phase prior to emulsification.

6. A method according to claim 5 wherein said method further comprises the addition of sodium nitrite after emulsification such that the diazonium salt decomposes to generate said nitrogen gas bubbles.

7. A method according to claim 1 wherein the aromatic amine is amino benzene.

8. A method according to claim 7 wherein the amino benzene is substituted at one or more ortho, meta or para positions.

9. A method according to claim 8 wherein the substituent groups are singly or in combination selected from fluoro, chloro, bromo, iodo, nitro, amino, alkyl, alkoxy and hydroxyl groups.

10. A method according to claim 2 wherein the explosive matrix comprise a watergel containing a continuous aqueous oxidizer salt phase, a dispersed solid/liquid fuel, thickeners, cross-linking agents and optionally chemical sensitizers.

* * * * *